United States Patent [19]

Townsend

[11] 4,052,029

[45] Oct. 4, 1977

[54] COMPRESSIBLE MINE SUPPORT

[75] Inventor: Rodney C. Townsend, Johannesburg, South Africa

[73] Assignee: Mine Support Systems (Proprietary) Limited, Johannesburg, South Africa

[21] Appl. No.: 609,951

[22] Filed: Sept. 3, 1975

[30] Foreign Application Priority Data

Sept. 5, 1974 South Africa ..... 74/5649

[51] Int. Cl.[2] ..... E04G 25/00

[52] U.S. Cl. ..... 248/356

[58] Field of Search ..... 248/356; 188/1 C

[56] References Cited

U.S. PATENT DOCUMENTS

| | | | |
|---|---|---|---|
| 1,752,101 | 3/1930 | Meutsch | 248/356 |
| 3,454,397 | 7/1969 | Yoshioka et al. | 188/1 C |

FOREIGN PATENT DOCUMENTS

| | | | |
|---|---|---|---|
| 569,550 | 8/1929 | Germany | 248/356 |
| 826,811 | 1/1952 | Germany | 248/356 |
| 604,346 | 10/1934 | Germany | 248/356 |
| 552,833 | 4/1943 | United Kingdom | 248/356 |
| 16,735 of | 1911 | United Kingdom | 248/356 |
| 319,091 | 9/1929 | United Kingdom | 248/356 |

*Primary Examiner*—Robert A. Hafer

*Attorney, Agent, or Firm*—Silverman & Cass, Ltd.

[57] ABSTRACT

This invention relates to a mine support for use in a hard rock deep level mine in which the hanging and foot walls in stopes are subject to closure. The support consists of a timber load-resisting element which is tightly housed in a sleeve of material which has a variable effective length and is adapted to contain transverse spread of the timber while the support is being compressed by the closing hanging and foot walls. It is essential to the invention that in use the grain of the timber element lies in the direction of the compressive load.

2 Claims, 8 Drawing Figures

COMPRESSIBLE MINE SUPPORT

This invention relates to a mine support which is particularly suitable for use in hard rock deep level mining.

The hanging walls in hard rock deep level stopes such as those in the South African gold mines are generally supported against closure during working by means of compressible mat or sandwich packs and in specific areas by wooden and/or hydraulic props.

The principle disadvantages of mat or sandwich packs are that their transportation and construction are labour intensive and therefore expensive, and because of the loose nature of the materials from which they are constructed they provide poor initial load resistance. Further disadvantages are that they are only adequately load resisting over only a short portion of their original length and are fire hazzards.

Wooden props consist of a single pole which is wedged between the hanging and foot wall of the stope. These supports are intended as temporary supports only as they have an extremely limited degree of compression. Various expedients have, however, been resorted to to prolong the time period during which the load develops to the full supporting ability of the prop. One of these consists in wedging the prop between a head and/ or foot board which is compressed before the full load is applied to the prop.

Another was the encasing of the prop, either as a single element or a number of sections of pole, in a rigid steel or iron tube with a length of pole projecting from one or both ends of the tube. The range of compression of these props equalled that of the plain wooden prop and their main advantage was that pieces of timber too short to be used as props could be utilized. The metal tubes were made from hard steel or iron and were specifically constructed for reuse.

Hydraulic props overcome many of the above problems but are expensive and their degree of compression is limited.

It is the object of this invention to provide a mine support which is substantially cheaper than an hydraulic prop and which overcomes or at least minimizes the problems mentioned above.

A mine support according to the invention includes a timber load resisting element, and means having a variable effective length encircling the timber element to restrain expansion of the element under load in a direction transverse to its grain.

The encircling means may consist of a sleeve of ductile material the length of which is preferably coextensive with that of the timber element.

Conveniently the sleeve includes two tubes adapted to telescope in the direction of the load on the support in use.

Preferably the timber element or elements are held tightly in the sleeve.

Figure 8:
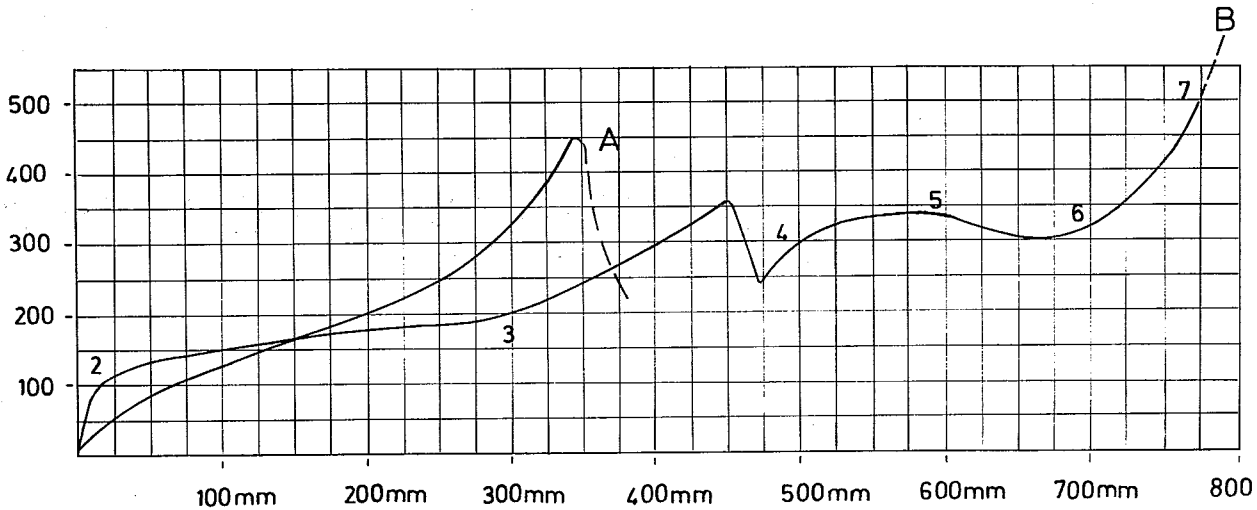
Figure 1:
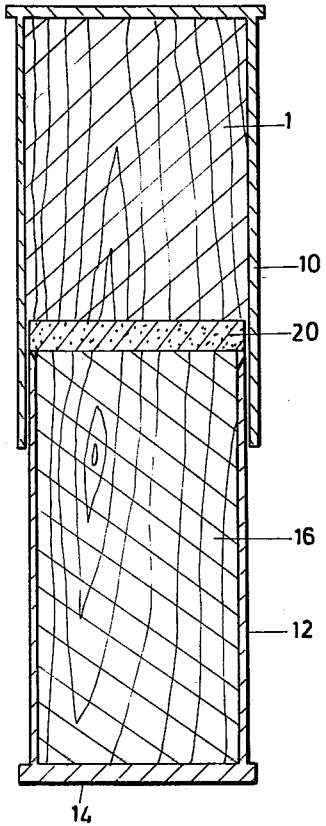
Figure 2:
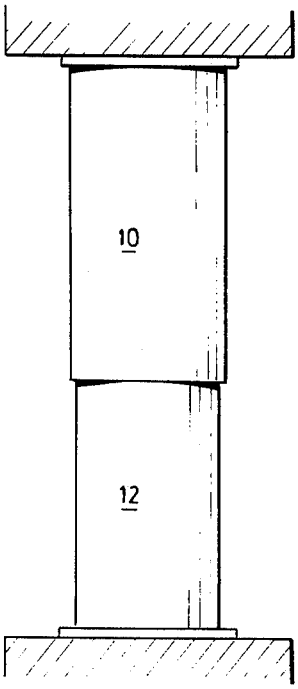
Figure 3:
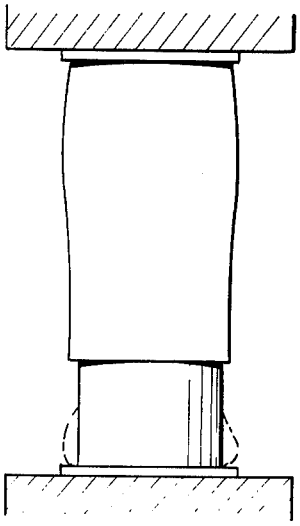
Figure 4:
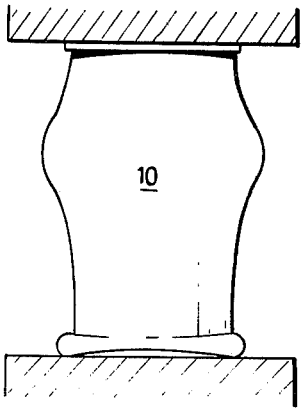

An embodiment of the invention is described by way of example with reference to the drawings in which:

FIG. 1 is a longitudinal cross-sectional view of the mine support of the invention, FIGS. 2 to 7 are partially diagrammatic side elevations of the support of FIG. 1 during progressive stages of compression under load, and FIG. 8 is a comparative graph illustrating the load supporting characteristics of the support of FIG. 1 and a sandwich pack under load.

The mine support illustrated in FIG. 1 of the drawing is shown to include telescopic metal tubes 10 and 12 each of which is closed at one end by a metal plate 14 which is secured by welding to the tube.

The metal from which the tubes 10 and 12 is made as well as its characteristics is important. The metal must be sufficiently ductile to be able to bulge transversely to the axial direction of the support to an extent sufficient to constrain the load resisting material while the support is being compressed under load to a small percentage of its original length.

Each tube is shown to contain a load resisting material which consists of a timber element 16 which has been preshaped to be a tight fit in the tube. If, however, the timber elements are not a tight fit in the tubes they should be tightly packed by a compressible filler such as rigid expanded polyurethane.

It is essential to the successful operation of the support that the grain of the timber elements lie parallel or substantially parallel to the axial direction of the support.

As is seen from the drawing the tube 12 is filled with load resisting material while the tube 10 is only partially filled.

the purpose of this arrangement is to provide the tubes with a limited degree of telescopic freedom in a longitudinal direction for the adjustment of its length. Immediately prior to use, the length of the support is adjusted, by means of loose discs 20 which are made from rigid expanded polyurethane, timber or a like load supporting material to the approximate height between the hanging wall and foot-wall.

FIGS. 2 to 7 illustrate the support of the invention under test. The tests were conducted using a 1000 ton (2,000 lbs.) press and the drawings, particularly in so far as the deformation of the tubes is concerned, are derived from a series of photographs of the test.

The tubes 10 and 12 of the support tested were made from S.A.B.S. 719A commercial grade electric resistance welded mild steel tube (A.P.I. 5L grade A) which has a yield under tension of 207 mega pascals and an ultmate tensile strength of 331 mega pascals.

The total original length of the support was 1 metre. The tube 10 had a wall thickness of approximately 6mm and an outside diameter of approximately 220mm and the tube 12 a wall thickness of approximately 6mm and an outside diameter of approximately 200mm. The elements 16 were a well dried timber. (Siligna, as used for props on the South African gold mines.)

Figure 5:
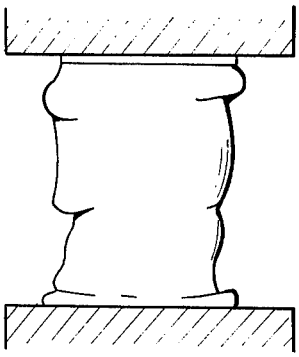
Figure 6:
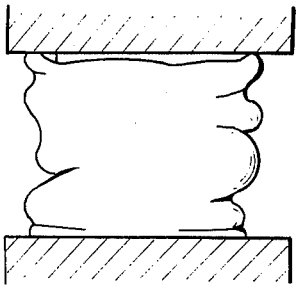
Figure 7:
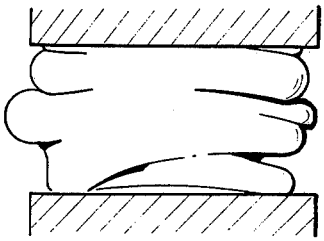

The various stages of compression of the support illustrated in FIGS. 2 to 7 are indicated at the relevant positions by like reference numbers on graph B of FIG. 7.

As is seen from the graph the support of the invention rapidly accepts load over a very small degree of initial compression (100 tons at approximately 1 percent compression.) Between positions 2 and 3 on the graph the timber elements are compressed in an axial direction, with little deformation of the tubes other than a slight bulging of the tube 10. At about 44 percent closure, however, a distinct bulge develops at or near the base of tube 12 (illustrated in dotted lines in FIG. 3). As the load increases the bulge at the base of the tube 12 continues to move outwardly until the load in an axial direction exceeds the tensile strength of the metal of tube 12 in the bulge. At this point the load falls off (immediately prior to position 4 on the graph) and the bulge, which has almost closed at its base forms in effect a constraining loop about the base of the tube. At position 4 (also FIG. 4) full telescopic closure of the tubes has taken place and the support again picks up the load. The slight fall off of load between positions 5 and 6 is due to the concertinaing of the tubes as illustrated in FIGS. 5 to 7. The test was stopped at a load of 500 tons at which time the support had been compressed to a little over 20 percent of its original length. At loads beyond this point, however, the remains of the support consolidate into a solid mass and the graph assumes the shape shown in dotted lines.

From the above description and the drawings, it is apparent that the successful operation of the support is largely dependent on the ability of the metal of the tubes 10 and 12 to deform to an extent sufficient for the formation of the bulges as the tubes concertina without premature splitting or bursting of the metal. In practice the tubes often do split at or beyond the FIG. 7 position. Splitting at this stage has, however, been found to have little or no effect on the dotted portion of graph B. The reason for this is probably due to the fact that what remains of the timber (fibrous material) is so trapped in the deformed metal of the tubes that it cannot escape and even though the tube metal is split the reamins of the support act as an almost solid support.

A desirable feature of a support employed in hard rock deep level mining is that it must be able to contain variations in velocity of the rate of closure of the hanging wall such as may be caused by rock bursts or other seismic disturbances. In this respect the support of the invention behaved well under controlled tests as well as underground during field tests where it has been subjected to velocities of closure in excess of 1 metre/-second and which were found to have resulted in a closure of the stope of approximately 100mm against the load resistance of the support.

Graph A in FIG. 8 comparitively illustrates the performances of a sandwich pack which was constructed from alternating layers of timber and concrete brick. The pack was 110cm high and had horizontal cross-sectional dimensions of 60 by 60cm. As is seen from graph A the pack is relatively slow to accept load and rapidly attains its ultimate load carrying capacity at about 35 percent compression beyond which point the concrete of the bricks and consequently the load resisting ability of the support failed.

I claim:

1. A compressible load absorbing mine support including a timber load-resisting element, a first sleeve of ductile mild steel surrounding said element completely in a direction transverse to its grain and extending beyond one end of the element to form a socket, a plunger consisting of a second timber element completely surrounded by a second sleeve of ductile mild steel, said plunger extending into said socket, said first and second sleeves being yieldable and deformable under significant loading so as to collapse without rupture, so that an increasing load applied across the support in the axial direction of said sleeves will cause the plunger to move telescopically into said first sleeve to crush the timber elements while the ductile sleeves yieldably constrain the timber against expansion in a direction transverse to its grain.

2. A mine support as claimed in claim 1 in which the mild steel has a maximum yield under tension of 207 mega pascals and an ultimate tensile strength of 331 mega pascals.

* * * * *